United States Patent [19]

Blanchard

[11] Patent Number: 4,563,155

[45] Date of Patent: Jan. 7, 1986

[54] STEERING POST MOUNTED PROPULSION ASSEMBLY

[75] Inventor: Clarence E. Blanchard, Kenosha, Wis.

[73] Assignee: Outboard Marine Corporation, Waukegan, Ill.

[21] Appl. No.: 211,642

[22] Filed: Dec. 1, 1980

[51] Int. Cl.[4] ..... B63H 25/42

[52] U.S. Cl. ..... 440/51; 440/61; 114/162

[58] Field of Search ..... 440/51, 53, 61, 900, 440/62; 114/39, 162–169; 248/640–643

[56] References Cited

U.S. PATENT DOCUMENTS

| | | | |
|---|---|---|---|
| 2,528,608 | 11/1950 | Richard et al. | 440/51 |
| 3,839,986 | 10/1974 | Meyer et al. | 440/61 |
| 3,881,443 | 5/1975 | Hamp | 248/640 |
| 4,232,627 | 11/1980 | Glenn et al. | 440/61 |
| 4,290,760 | 9/1981 | Lindblad | 440/51 |

*Primary Examiner*—Trygve M. Blix
*Assistant Examiner*—Stephen P. Avila
*Attorney, Agent, or Firm*—Michael, Best & Friedrich

[57] ABSTRACT

Disclosed herein is a marine propulsion device for a boat hull having a transom, which device comprises a steering post having a longitudinal axis and adapted to be connected to the boat transom for rotation about the longitudinal axis, a propulsion assembly including a rotatably mounted propelling element, and linkage connecting the propulsion assembly and the steering post for common pivotal movement about the longitudinal axis and for movement of the propulsion assembly relative to the steering post between a running position and a second position elevated from the running position and against steering movement of the propulsion unit assembly relative to the steering post.

2 Claims, 5 Drawing Figures

STEERING POST MOUNTED PROPULSION ASSEMBLY

RELATED APPLICATION

Attention is directed to my related application Ser. No. 211,530, filed 12/01/80 and entitled: Marine Propulsion Device for Sailboats, now abandoned.

BACKGROUND OF THE INVENTION

The invention relates generally to marine propulsion devices and, more particularly, to marine propulsion devices adapted for propelling sailboats which are commonly steered by a rubber located either under the hull or behind the transom.

In the past, outboard motors have sometimes been mounted on the transom of a sailboat, but, in general, such mounting has been relatively inaccessible, and consequently, the steering capability of the outboard motor was seldom used and the propeller was often undesirably trailed in the water when the boat was under sail. In addition, in instances when the rudder was mounted on the transom, the outboard motor had to be mounted to one side in an inefficient location.

Attention is directed to the following U.S. Patents:

| | | | |
|---|---|---|---|
| Jeanson | 4,143,614 | issued | March 13, 1979 |
| Krautkremer | 3,683,841 | " | August 15, 1972 |
| Adams | 3,809,343 | " | May 7, 1974 |
| Moberg | 3,581,702 | " | June 1, 1971 |
| Roberts | 4,004,705 | " | August 30, 1977 |
| Wagner | 3,096,959 | " | July 9, 1963 |
| Forbes | 2,908,242 | " | October 13, 1959 |
| Briggs | 2,178,555 | " | November 7, 1939 |
| Corcoran | 1,800,135 | " | April 7, 1931 |

SUMMARY OF THE INVENTION

The invention provides a marine propulsion device for a boat hull having a transom, which device comprises a steering post having a longitudinal axis and adapted to be connected to the boat transom for rotation about the longitudinal axis, a propulsion assembly including a rotatably mounted propelling element, and means connecting the propulsion assembly and the steering post for common pivotal movement about the longitudinal axis and for movement of the propulsion assembly relative to the steering post between a running position and a second position elevated from the running position and against steering movement of the propulsion unit assembly relative to the steering post.

In one embodiment of the invention, the marine propulsion device further includes a rudder element connected to the steering post for common movement therewith about the longitudinal axis of the steering post.

In one embodiment of the invention, the means connecting the propulsion assembly and the steering post includes a bracket member which is fixed to the steering post for common movement therewith, which has a part extending radially of the longitudinal axis, and which is connected to the propulsion assembly, and wherein the rudder element is fixedly connected to the bracket member part.

In one embodiment in accordance with the invention, the means connecting the propulsion assembly and the steering post includes means for pivotally connecting the propulsion assembly to the steering post about an axis which is horizontal when the steering post is boat mounted and for selectively displacing the propulsion assembly relative to the steering post between the running position and the spaced position.

In one embodiment in accordance with the invention, the means connecting the propulsion assembly and the steering post includes means for selectively rectilinearly displacing the propulsion unit assembly relative to the steering post between the running position and the second position.

In one embodiment in accordance with the invention, the means for selectively rectilinearly displacing the propulsion assembly displaces the propulsion assembly generally vertically.

In one embodiment in accordance with the invention, the means for selectively rectilinearly displacing the propulsion assembly further includes means for preventing pivotal movement in a vertical plane of the propulsion assembly with respect to the link.

In one embodiment in accordance with the invention, the means for selectively rectilinearly displacing the propulsion assembly comprises a link which is extensible and contractable and which is connected, at one end, to the steering post and connected, at the other end, to the propulsion assembly.

Other features and advantages of the embodiments of the invention will become known by reference to the following general description, claims and appended drawings.

IN THE DRAWINGS

Figure 3:
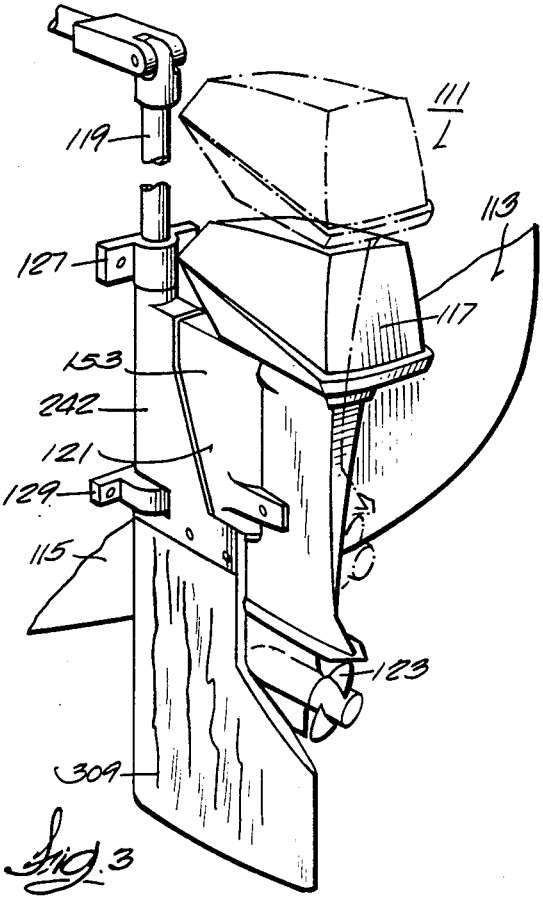
FIG. 3 is a perspective view of a second embodiment of a marine propulsion device which embodies various of the features of the invention and which is shown with the propulsion assembly in the running position in full lines and in the raised or elevated position in dotted outline.

Before explaining one embodiment of the invention in detail, it is to be understood that the invention is not limited in its application to the details of construction and the arrangement of components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

GENERAL DESCRIPTION

Shown in the drawings is a marine propulsion installation 11 including a boat hull 13 having a transom 15 and a marine propulsion device 17 comprising a steering post 19 having an upright longitudinal axis, together with means vertically mounting the steering post 19 on the rear of the boat transom 15 for pivotal movement about its longitudinal axis. In addition, the marine propulsion device 17 includes a propulsion assembly 21 including a propeller 23, and means 25 connecting the propulsion assembly 21 to the steering post 19 for common pivotal movement about the axis of the steering post 19, and for movement of the propulsion assembly 21 relative to the steering post 19 between a lower running position (shown in full lines) with the propeller 23 in the water and a raised position above the running position (shown in dotted lines) and preferably with the propeller 23 out of the water, and against steering movement of the propulsion assembly 21 relative to the steering post 19.

While other constructions could be employed, the steering post 19 comprises an elongated cylindrical rod or element which is rotatably journalled by a pair of spaced upper and lower transom brackets 27 and 29 fixed to the bracket transom 15. At its upper end, the steering post 19 terminates in a vertically extending ear 31 which is received between a pair of spaced lugs 35 provided on the rearward end of a fragmentarily illustrated tiller arm 37. The tiller arm 37 is connected to the ear 31 of the steering post 19 by a suitable pin 39 which extends through the ear 31 and the lugs 35 so that horizontal swinging movement of the tiller arm 37 causes associated pivotal movement of the steering post 19 about its axis.

The propulsion assembly 21 comprises a propulsion unit 51 which includes the propeller 23 and which can be generally of conventional construction, together with a connecting bracket 53 which is fixedly secured to the propulsion unit 51 except that elastomeric mounts (not shown) are preferably employed between the connecting bracket 53 and the propulsion unit 51 so as to vibrationally isolate the connecting bracket 53 from the propulsion unit 51. As a consequence, minor immaterial movement of the propulsion unit 51 relative to the connecting bracket 53 is afforded. However, for practical purposes, the propulsion unit 51 and connecting bracket 53 are rigidly secured together.

The propulsion unit 51 comprises a powerhead 55 including an internal combustion engine 57, together with a lower unit 59 which includes a drive shaft housing 61 rigidly secured to the bottom of the powerhead 55, and a gear case 63 which is rigidly secured to the bottom of the drive shaft housing 61 and which rotatably supports a propeller shaft 65 carrying the propeller 27. Extending through the drive shaft housing 61 is a drive shaft 67 which is drivingly connected to the engine 57 and to a reversing transmission 69 located in the gear case 63 and connected to the propeller shaft 65.

The connecting bracket 53 is connected to the drive shaft housing 61 at vertically spaced points, indicated generally at 71 and 73, and extends forwardly and upwardly therefrom by means including a pair of laterally spaced legs 75 having forwardly and upwardly located end portions 77 including respective, laterally, aligned transverse bores 79.

Figure 1:
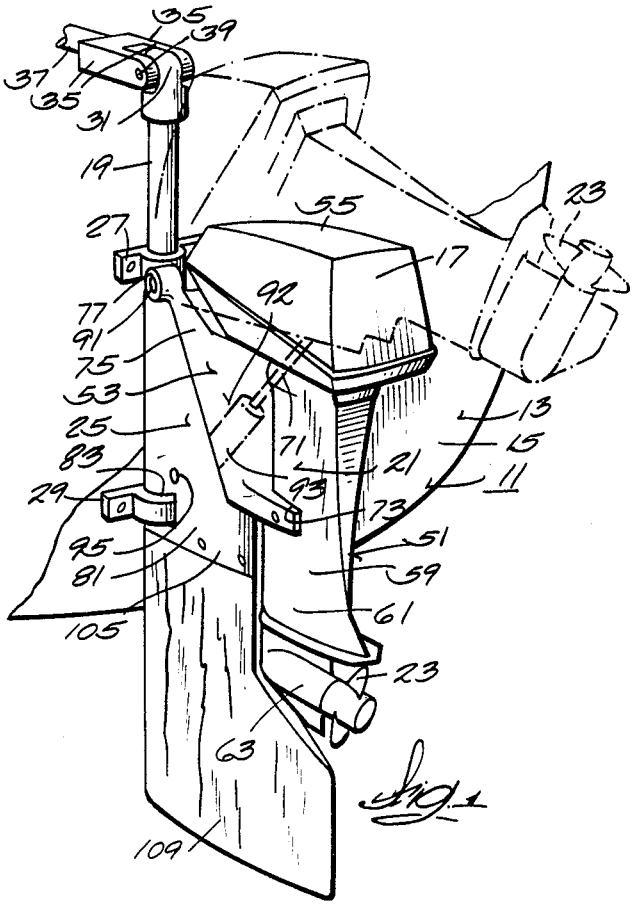
FIG. 1 is a perspective view of one embodiment of a marine propulsion device which embodies various of the features of the invention and which is shown with the propulsion assembly in the running position in full lines and in the raised or elevated position in dotted outline.
Figure 2:
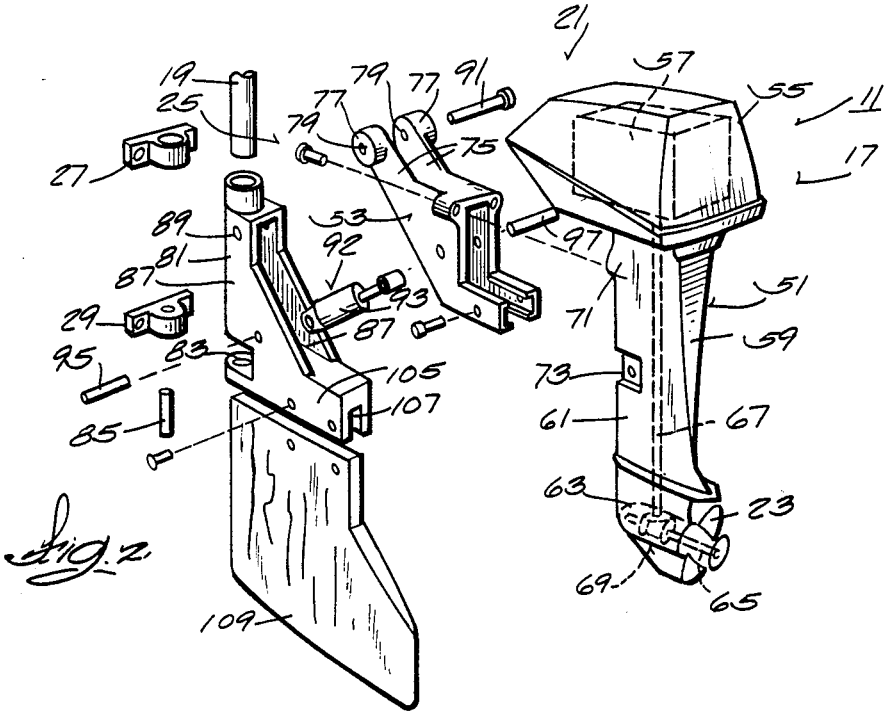
FIG. 2 is a partial, exploded perspective view of the marine propulsion device shown in FIG. 1.
Figure 4:
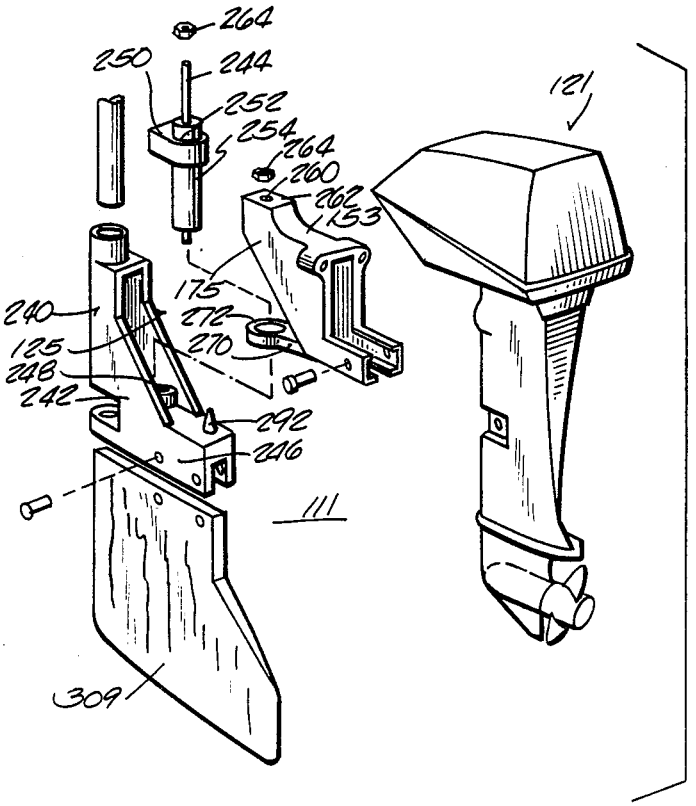
FIG. 4 is an exploded perspective view of the marine propulsion device shown in FIG. 3.
Figure 5:
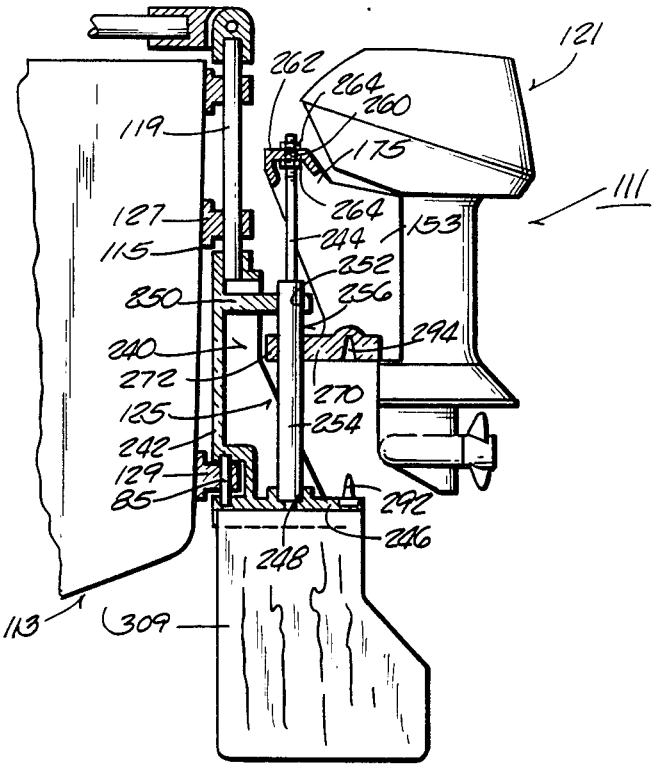
FIG. 5 is a side elevational view, partially in section of the marine propulsion device shown in FIG. 3 and with the propulsion assembly shown in the raised position.

Various means can be provided for connecting the propulsion assembly 21 to the steering post 19 for common pivotal movement and for displacement of the propulsion assembly 21 between the lower running position and the elevated position. In the construction illustrated in FIGS. 1 and 2, such means includes a link or bracket 81 which is fixed by any suitable means to the lower end of the steering post 19 and which, in part, constitutes an extension thereof. In this last regard, the lower forward end of the bracket 81 is provided with a slot 83 which receives the lower transom bracket 29 and the bracket 81 is bored from the bottom in axial alignment with the steering post 19. A steering pintle bolt 85 extends into the bottom of the bore, through the lower transom bracket 29 and is threaded into the bracket 81 to afford a lower support for pivotal steering movement of the steering post 19.

The bracket 81 includes a pair of laterally spaced wing portions 87 which extend rearwardly from a forward part of the bracket 81 and which have a rearward extent which increases with the downward extent of the wings. Thus, the wing portions 87 generally take the shape of a 90°-45°-45° triangle with the hypotenuse leg extending rearwardly and downwardly. The wing portions 81 are laterally spaced apart at a distance greater than the legs 75 of the connecting bracket 53 so as to permit disposition of the connecting bracket legs 75 in inwardly adjacent relation to the wing portion 35 of the bracket 81 for transmission therebetween of side thrust. The wing portions 87 include, adjacent the top thereof, respective, laterally aligned bores 89.

The means 25 connecting the propulsion assembly 21 to the steering post 19 for pivotal movement of the propulsion assembly 21 in common with the steering post 19 also provides for pivotal movement of the propulsion assembly 21 relative to the steering post 19 between the running position and the raised or tilt position and includes, in addition to the transverse bores 79 and 89, a tilt pin or link 91 which extends horizontally and through the bores 79 and 89 and which, together with the bores 79 and 89, prevents relative movement between the propulsion assembly 21 and the steering post 19 except for the just mentioned pivotal tilting movement. More specifically, the connection of the propulsion assembly 21 to the steering post 19 does not provide for steering movement of the propulsion assembly 21 relative to the steering post 19.

Means 92 are provided for selectively tiltably displacing the propulsion assembly 21 upwardly about the horizontal tilt axis provided by the tilt pin 91 from the lowered running position to the elevated or raised tilt position with the propeller 23 desirably located out of the water. While various arrangements can be employed, in the illustrated construction, such means 92 comprises a link 93 which is expansible and contractable, which, at one end, is pivotally connected to the bracket 81 by a pin 95 and which, at the other end, is pivotally connected by a pin 97 to the connecting bracket 53. Any suitable expandable link can be employed. In the illustrated construction, the link 93 comprises a hydraulic cylinder-piston assembly. Any suitable means (not shown) can be employed for controllably supplying and draining pressure fluid to and from the opposite ends of the cylinder so as to pivotally displace the propulsion assembly 21 between the lowered running position and the raised tilt position with the propeller 23 out of the water.

In order to facilitate substitution of rudder members of differing shapes to accommodate differing installation requirements, the bracket 81 includes, at its lower end, a rearwardly extending part or foot 105 which has a substantial radial extent beyond the outer end of the wing portions 87, and which is provided, on the under surface thereof, with a radially and rearwardly extending slot 107 which receives the upper margin of a suitably formed rudder member 109. Any suitable means can be employed to maintain the rudder member 109 in

United States Patent [19]

Bissig

[11] Patent Number: 4,563,156

[45] Date of Patent: Jan. 7, 1986

[54] RESCUE APPARATUS

[76] Inventor: Josef E. Bissig, 175 Emil Frey-Strasse, CH-4142 Münchenstein, Switzerland

[21] Appl. No.: 589,065

[22] PCT Filed: May 19, 1983

[86] PCT No.: PCT/CH83/00064

§ 371 Date: Feb. 2, 1984

§ 102(e) Date: Feb. 2, 1984

[87] PCT Pub. No.: WO83/04234

PCT Pub. Date: Dec. 8, 1983

[30] Foreign Application Priority Data

Jun. 2, 1982 [CH] Switzerland ..... 3405/82
Jun. 2, 1982 [CH] Switzerland ..... 3406/82
Jun. 2, 1982 [CH] Switzerland ..... 3407/82

[51] Int. Cl.[4] ..... B63C 9/16

[52] U.S. Cl. ..... 441/99; 441/100; 441/123; 222/5

[58] Field of Search ..... 441/90, 91, 92, 93, 441/94, 95, 96, 97, 98, 99, 100, 101, 41, 42; 244/140; 89/1.5 D; 222/5

[56] References Cited

U.S. PATENT DOCUMENTS

| | | | |
|---|---|---|---|
| 1,811,847 | 6/1931 | Hellrich | 441/96 |
| 2,173,567 | 9/1939 | Shafer | 441/93 |
| 2,894,658 | 7/1959 | Spidy | 441/95 |
| 3,682,354 | 8/1972 | Witte | 222/3 |
| 3,693,202 | 9/1972 | Ohtani | 441/97 |
| 3,812,546 | 5/1974 | Witte | 441/97 |
| 3,988,795 | 11/1976 | Robertson | 441/123 |

FOREIGN PATENT DOCUMENTS

| | | | |
|---|---|---|---|
| 599982 | 7/1934 | Fed. Rep. of Germany . | |
| 1240756 | 5/1967 | Fed. Rep. of Germany . | |
| 1960650 | 8/1970 | Fed. Rep. of Germany . | |
| 2432629 | 2/1980 | France . | |
| 302933 | 11/1932 | Italy | 89/1.5 D |
| 569611 | 11/1975 | Switzerland . | |
| 197712 | 12/1977 | U.S.S.R. | 441/95 |

*Primary Examiner*—Trygve M. Blix
*Assistant Examiner*—Thomas J. Brahan
*Attorney, Agent, or Firm*—Watson, Cole, Grindle & Watson

[57] ABSTRACT

The rescue-unit includes a housing containing, a folded floating element and a bottle of compressed gas for automatic inflation of the floating element in the water. Inflation is initiated as soon as disc-like support-elements, placed on edge, become soft and buckle, when water enters, and thus no longer prevent actuation of a valve loaded by a spring located below the bottle of compressed gas. The spring can be completely released, for the purpose of actuating the valve of the compressed-gas bottle, only when a locking element, projecting into a preloading device loaded by the spring, is removed. The locking element is firmly connected to a retainer in which the housing is secured. When the housing is withdrawn from the retainer, the preloading device is automatically unlocked, leaving the rescue-unit ready for automatic inflation of the floating element as soon as the water gains access to the support-elements. The latter may also be destroyed by pulling on a cord, which allows the floating element to be inflated immediately by the bottle of compressed gas. In an emergency, this allows a person to put on the floating element before jumping into the water. The floating element is itself in the form of a U-shaped collar encircling the person's neck only.

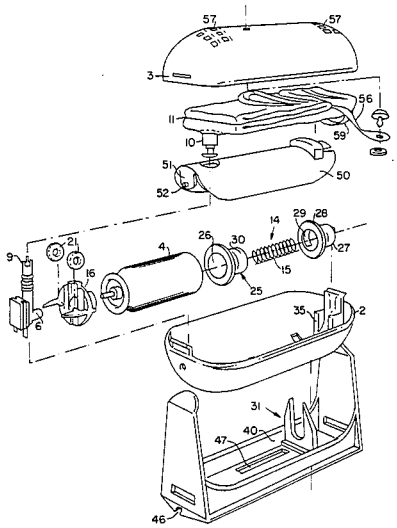

14 Claims, 10 Drawing Figures